United States Patent [19]

Jellinek

[11] Patent Number: 4,631,226

[45] Date of Patent: Dec. 23, 1986

[54] COMPOSITIONS FOR THE TREATMENT OF TEXTILE MATERIALS

[75] Inventor: Thomas Jellinek, Plenty, Australia

[73] Assignee: Commonwealth Scientific and Industrial Research Organization, Campbell, Australia

[21] Appl. No.: 713,703

[22] Filed: Mar. 19, 1985

Related U.S. Application Data

[60] Division of Ser. No. 494,290, May 13, 1983, Pat. No. 4,520,143, which is a continuation-in-part of Ser. No. 300,217, Sep. 8, 1981, abandoned, which is a continuation of Ser. No. 175,371, Aug. 5, 1980, abandoned, which is a continuation of Ser. No. 33,504, Apr. 26, 1979, abandoned.

[30] Foreign Application Priority Data

May 9, 1978 [AU] Australia ..... PD4334

[51] Int. Cl.[4] ..... B05D 3/00

[52] U.S. Cl. ..... 428/270; 428/260; 427/272; 427/389.9; 523/410; 523/420

[58] Field of Search ..... 523/410, 420; 428/270, 428/260; 427/272, 389.9

[56] References Cited

U.S. PATENT DOCUMENTS

| | | | |
|---|---|---|---|
| 2,606,810 | 8/1952 | Erickson et al. | 8/127.6 |
| 2,781,335 | 2/1957 | Cupery | 525/378 |
| 2,787,561 | 4/1957 | Sanders | 523/410 |
| 2,817,602 | 12/1957 | Pardo, Jr. | 427/386 |
| 3,029,286 | 4/1962 | Bressler et al. | 528/111 |
| 3,988,281 | 10/1976 | Minami et al. | 523/410 |
| 4,520,143 | 5/1985 | Jellinek | 523/410 |

FOREIGN PATENT DOCUMENTS

| | | | |
|---|---|---|---|
| 0006678 | 9/1980 | European Pat. Off. | 523/420 |

*Primary Examiner*—Paul R. Michl
*Assistant Examiner*—Alex H. Walker
*Attorney, Agent, or Firm*—Kerkam, Stowell, Kondracki & Clarke

[57] ABSTRACT

Compositions for textile treatment comprising an admixture of:

(a) an aqueous emulsion of a copolymer of a monomeric mixture consisting essentially of an oxirane-containing monoethylenically-unsaturated material and at least one other monoethylenically-unsaturated material selected from the group characterized by the formula

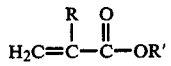

wherein R is H or $C_1$ to $C_4$ alkyl and R′ is a straight chain or branched chain radical of a primary or secondary alkanol, alkoxyalkanol or alkylthiaalkanol having up to 14 carbon atoms, and (b) a water soluble or water dispersible polyamine which is composed of at least 4 alkylenimine units (—CH—CH—N—) which occur in sequences of such alkylenimine units having the formula A

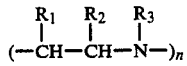

(A)

wherein $R_1$ and $R_2$ are independently selected from hydrogen, and lower alkyl radicals of 1 to 4 carbon atoms, $R_3$ is H or other alkylenimine sequences of formula A, and n is a number which has an average value of at least 2, wherein the admixture (a) and (b) is further characterized in that it exists as a stable emulsion at a pH in the range 3 to 11 and wherein the proportion of polyamine (b) is such that the sequences of alkylenimine units of formula A represent from 0.5% to 25% by weight of the non-volatile material in the combined mass of the emulsion copolymer and polyamine.

The compositions may be used at low application levels so that wool-containing textiles in particular may be rendered shrink-resistant without impairment to their handle, color, strength or other desirable properties of the fibre.

17 Claims, No Drawings

COMPOSITIONS FOR THE TREATMENT OF TEXTILE MATERIALS

This is a divisional of application Ser. No. 494,290, filed May 13, 1983 now U.S. Pat. No. 4,520,143, which is a continuation-in-part of Ser. No. 06/300,217, filed Sept. 8, 1981, now abandoned, which is a continuation application of Ser. No. 06/175,371, filed Aug. 5, 1980 now abandoned; which is a continuation application of Ser. No. 06/033,504, filed Apr. 26, 1979, now abandoned.

BACKGROUND OF THE INVENTION

1. Field of the Invention

This invention relates to compositions for the treatment of textile materials, to processes for their application, and to the products of such processes. The object of the textile treatment is to improve certain textile properties, and in particular the dimensional stability of textile articles, especially those which contain wool or other animal hairs.

2. Description of the Prior Art

It is well known in the art that many textile fabrics exhibit poor dimensional stability. For example, laundering causes severe shrinkage of textiles composed of wool or other animal hairs. This technical disadvantage seriously restricts the applications of wool in the consumer market and much research has been undertaken in order to modify the surface of the undertaken in order to modify the surface of the natural fibres in order to provide them with resistance to shrinking. The most useful of the processes currently being advocated involves the use of costly polymeric compositions of limited commercial availability. Where these compositions are capable of being cured (crosslinked) under relatively mild conditions, it is found that their storage stability is poor due to premature cross-linking. Still other treatments involve complex multistage processes, impart an undesirable harshness to the material, or damage the fibres and reduce wearing properties.

Emulsions of vinyl copolymers which are crosslinkable offer an attractive method of treating textiles since they are inexpensive to manufacture, confer a soft handle, and are stable to heat, light and drycleaning. Accordingly, a large variety of such polymers have become available commercially, the majority of which are crosslinkable via N-methylol groups and an acid catalyst (see H. Warson, The Applications of Synthetic Resin Emulsions, Ernest Benn Ltd., London, 1972). Unfortunately, copolymers of this type show very poor washfastness on certain textile materials, especially those containing wool or other keratinous fibres and therefore cannot impart shrinkresistance to these materials at low application levels (i.e. less than about 4% on weight of material). Oxirane containing vinyl copolymers are rarely used in textile treatments at the present time since they have hitherto failed to provide a significant improvement in properties over the somewhat cheaper N-methylol containing counterparts. Oxirane groups, however, can be readily introduced into vinyl copolymers by copolymerization of glycidyl-containing monomers for example.

Glycidyl-containing copolymers are disclosed in U.S. Pat. No. 2,606,810 for the treatment of wool-containing textiles. It is found in practice, however, that the very high treatment levels of 7% or more which are necessary to impart shrinkresistance to prolonged laundering results in an unacceptable impairment to the handle. This is particularly evident in highly susceptible fabrics such as fine worsteds. Similar considerations apply to the oxirane containing copolymers disclosed in British Pat. No. 935,018 (Copolymers of cyclic epoxyalkyl methacrylates) or in U.S. Pat. No. 3,678,098 (copolymers of amino substituted acrylates which have been alkylated with an epihalohydrin). Moreover, it is found that no substantial improvement is gained by employing conventional acidic or basic catalysts or additional crosslinking agents such as the aminoplast resins or epoxy resins, the use of which is well known in the art (see H. Mark, N. S. Wooding and S. M. Atlas, "Chemical Aftertreatment of Textiles", Wiley, N.Y., 1971).

The use of a variety of polyamines is also known in the prior art. U.S. Pat. No. 2,925,317 discloses a shrinkresist treatment for wool involving various polyalkylenimines. However, in practice it is found that at application levels which achieve only moderate shrinkresistance, the fabrics are conferred with an unacceptable harshness and an intolerable degree of yellowing after curing, presumably due to the high level of amino nitrogen which is present and which becomes subject to oxidation under these conditions.

These problems are not overcome when the compositions also contain epoxy resins as disclosed in U.S. Pat. No. 2,817,602 since the moderate level of shrink resistance which is achieved is only possible when the polyalkylenimine represents more than two thirds of the applied solids. Alternative polymeric polyamines are disclosed in U.S. Pat. No. 2,781,335 as the reaction product of solution polymerized glycidyl-containing copolymers and monoamines, but in practice, adequate shrink resistance is not obtained at low application levels. Similarly, the limited shrinkresist effectiveness of the water soluble reaction products of isocyanate prepolymers and polyamine hydrochlorides in compositions containing a polyacrylate has been described recently by B. O. Bateup and B. E. Fleischfresser (Textile Research Journal Vol. 48, 417 (1978)).

Additional compositions from which one obtains in practice only a limited degree of shrinkresistance are disclosed in Australian Pat. No. 474,471 in which blends of an anionic polymer and a polymeric cationic compound (e.g. polyethylenimine of molecular weight above 2,000) are employed, preferably in the presence of a crosslinking agent and mercapto compounds. Amongst the group of suitable anionic polymers are mentioned polyacrylates containing a wide variety of reactive groups; the patentees indicating a preference only for the carboxyl group. In examples 1, 2, 3, 4, 5, 6 and 8 thereof, commercial polyacrylates of unknown composition are employed.

A further disadvantage which limits the utility of the abovementioned prior art processes is that techniques for the exhaustion onto textile materials from a long liquor have not been developed. This is a method of application which is particularly suited to knitted garments and garment pieces.

SUMMARY OF THE INVENTION

It is an object of the present invention to provide compositions for textile treatment which comprise inexpensive vinyl copolymers as the major components. It is a particular object of the present invention to provide highly efficient compositions which may be used at extremely low application levels so that wool-containing textiles in particular may be rendered shrink-resistant without impairment to their handle, color, strength or other desirable properties of the fibre. It is a particular object of the present invention to provide compositions which are extremely stable yet cure under mild conditions, and to develop techniques by which they may be applied to textile materials by exhaustion from a long liquor.

The objects of the present invention are provided by compositions comprising an admixture of:

(a) an aqueous emulsion of a copolymer of a monomeric mixture consisting essentially of an oxirane-containing monoethylenically-unsaturated material and at least one other monoethylenically-unsaturated material selected from the group characterised by the formula

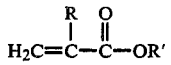

wherein R is H is $C_1$ to $C_4$ alkyl and R′ is a straight chain or branched chain radical of a primary or secondary alkanol, alkoxyalkanol or alkylthiaalkanol having up to 14 carbon atoms, and (b) a water soluble or water dispersible polyamine which is composed of at least 4 alkylenimine units (—CH—CH—N—) which occur in sequences of such alkylenimine units having the formula A

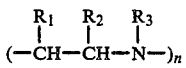

(A)

wherein $R_1$ and $R_2$ are independently selected from hydrogen, and lower alkyl radicals of 1 to 4 carbon atoms, $R_3$ is H or other alkylenimine sequences of formula A, and n is a number which has an average value of at least 2, wherein the admixture (a) and (b) is further characterised in that it exists as a stable emulsion at a pH in the range 3 to 11 and wherein the proportion of polyamine (b) is such that the sequences of alkylenimine units of formula A represent from 0.5% to 25% by weight of the non-volatile material in the combined mass of the emulsion copolymer and polyamine.

The compositions of the invention may also include one or more additional components selected from the group consisting of:

acids, bases, electrolytes, wetting agents, colloid stabilizers, surfactants or compatible water-soluble or water-dispersible polymers which may be necessary depending on the chemical or physical state of the textile material and the method of application.

DETAILED DESCRIPTION OF THE INVENTION

In preferred compositions of the invention the oxirane-containing, monoethylenically-unsaturated material is a monomeric compound such as glycidyl acrylate or glycidyl methacrylate or a mixture thereof. Other suitable monomers include glycidyl crotonate, glycidyl abietate, allyl glycidyl ether, methallyl glycidyl ether, glycidyl vinyl ether, dipentene monoxide, and the quaternary monomers disclosed in U.S. Pat. No. 3,678,098 which are said to exist in part as an oxirane containing form upon polymerization. Formula B is an example of the latter.

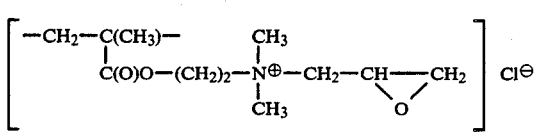

(B)

The remainder of the copolymer consists essentially of at least one other monoethylenically-unsaturated monomer, preferably a monomer which may be classed as a so-called "soft" monomer. For the purposes of this specification "soft" monomers are those which may be represented by the formula:

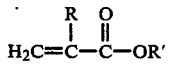

wherein R is H or $C_1$ to $C_4$ alkyl and R′ is a straight chain or branched chain radical of a primary or secondary alkanol, alkoxyalkanol or alkylthiaalkanol, and having up to 14 carbon atoms. Examples of R′ are methyl ethyl, propyl, n-butyl, 2-ethylhexyl, heptyl, hexyl, octyl, 2-methylbutyl, 1-methylbutyl, butoxybutyl, 2-methylpentyl, methoxymethyl, ethoxyethyl, cyclohexyl, n-hexyl, isobutyl, ethoxythiaethyl, ethylthiapropyl, n-octyl, 6-methylnonyl, decyl and dodecyl.

Preferably, the present invention provides a composition in which the aqueous emulsion is comprised of an essentially linear, film forming copolymer of a monomeric mixture consisting essentially of an oxirane containing monoethylenically-unsaturated material and at least one other monoethylenically-unsaturated material selected from the group characterised by the formula

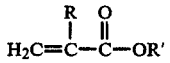

wherein (i) R is H and R′ is $C_2$ to $C_8$ alkyl and (ii) R is $CH_3$ and R′ is $C_1$ to $C_8$ alkyl, the said copolymer being further characterised in having a glass transition temperature in the range −50° to +40° C. and an epoxy content in the range 0.25 to 1.80 equivalents/kg.

Another preferred aspect of the present invention provides a composition in which the aqueous emulsion is comprised of a copolymer of a monomeric mixture consisting essentially of an oxirane-containing monoethylenically-unsaturated material and at least one other monoethylenically-unsaturated material selected from the group characterised by the formula

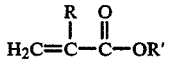

wherein (i) R is H and R′ is $C_4$ to $C_8$ alkyl and (ii) R is $CH_3$ and R′ is $C_1$ to $C_8$ alkyl, said other monoethylenically unsaturated material comprising at least 40% by weight of the monomer composition of the copolymer.

Another preferred aspect of the present invention is a composition in which the aqueous emulsion is comprised of a copolymer of a monomeric mixture consisting essentially of glycidyl methacrylate and at least one other monoethylenically-unsaturated material selected from the group comprising butyl acrylate, butyl methacrylate, 2-ethylhexyl acrylate, 2-ethylhexyl methacrylate and methyl methacrylate, said other monoethylenically-unsaturated material comprising from 50 to 90% by weight of the monomer composition of the copolymer.

Another preferred aspect of the present invention is a composition in which the aqueous emulsion is comprised of a copolymer of a monomeric mixture consisting essentially of 4 to 30% glycidyl methacrylate and from 50 to 96% of butyl acrylate.

Another preferred aspect of the present invention is a composition in which the aqueous emulsion is comprised of a monomeric mixture consisting essentially of 4 to 30% glycidyl methacrylate and from 50 to 96% of a combination of butyl acrylate and butyl methacrylate.

Another preferred aspect of the present invention is a composition in which the aqueous emulsion is comprised of a monomeric mixture consisting essentially of 4 to 30% glycidyl methacrylate and from 50 to 96% of a combination of butyl acrylate and methyl methacrylate.

Other ethylenically unsaturated copolymerizable vinyl monomers, the homopolymers of which have a much higher glass transition temperature (Tg) may be used in combination with the abovementioned monomers to provide an increased stiffness in the impregnated textile material. The stiffness is related to the Tg of the resultant copolymer. Such monomers are known as "hard" monomers, examples of which include acrylonitrile, methyl methacrylate, ethyl methacrylate, styrene, isopropenyl toluene, N-vinyl pyrrolidone, vinyl chloride, vinyl acetate, vinylidene chloride, methyl vinyl ketone, dimethyl itaconate, methallyl acetate, 4-vinyl pyridine, vinyl pyrrole and the like. Ethylenically unsaturated monomers containing functional groups other than oxirane may be optionally included in the copolymer composition. These monomers which contain reactive hydrogen atoms in amide groups ($-CONH_2$) and hydroxyl groups ($-OH$) for example may be coreactive with oxiranyl groups under the conditions of cure but are not coreactive with oxiranyl groups under the conditions of polymerization. Examples include acrylamide, methacrylamide, 2-hydroxyethyl acrylate or methacrylate, N-2-hydroxyethyl acrylamide or methacrylamide, 2-hydroxypropyl acrylate or methacrylate, N-2-hydroxypropyl acrylamide or methacrylamide, and 2-hydroxyethyl or 2-hydroxypropyl vinyl ether or vinyl sulphide. The preferred functional monomers having active hydrogen atoms are the hydroxyalkyl acrylates and methacrylates and their proportion should not exceed 20% of the total weight of monomers. The use of higher proportions of such monomers results in a deterioration in the wash resistance of the polymer film. In addition, it may be desirable for certain applications to include ethylenically unsaturated monomers which confer cationic charges on the emulsion particles, provided that these monomers are compatible with the other comonomers in the composition. Suitable cationic monomers include the alkyl aminoalkyl acrylates and methacrylates and their quaternization products with dimethyl sulfate and methyl chloride for example. Illustrative examples include dimethylaminoethyl acrylate and methacrylate, diethylaminoethyl acrylate and methacrylate, di-t-butylamino-ethyl acrylate and methacrylate, trimethylammoniummethyl methacrylate methosulphate, trimethylammoniumethyl methacrylate chloride, methyl diethylammoniumethyl methacrylate methosulphate and the like. Where an ionic charge on the particles is desirable the proportion of these ionic or ionizable monomers should not exceed 10% by weight of the total monomer mixture and preferably not more than 7%. A preferred hard monomer is methylmethacrylate.

It is preferred that the monomers be selected to provide a copolymer having a glass transition temperature (Tg) below 0° C. in order that the impregnated textile material retains a soft, resilient hand. However, it is appreciated that for special effects requiring a firmer or bulkier handle, the application of copolymers having a higher Tg may be necessary. The preferred range of Tg of copolymers is from −50° to +40° C. The molecular weight of the copolymers of this invention may be from 10,000 to 10,000,000.

In preparing emulsion copolymers in accordance with this invention, the procedure of polymerization is one which will produce fine particle size emulsions. Preferred particle size is from 0.05 to 1 micron, though from 0.01 to 3 microns is broadly contemplated. The fine particle size emulsions are prepared by incrementally or continuously adding the unsaturated copolymerizable material or an aqueous emulsion thereof to an aqueous solution which has dispersed therein surface active agents. The addition is made under conditions conducive to addition copolymerization so that copolymerization takes place as the materials are added, thus allowing formation of fine particle size emulsions. Suitable conditions are achieved in the presence of an appropriate catalyst system, preferably in the absence of oxygen and by maintaining the temperature of the aqueous phase between about 30° C. to 95° C., preferably from about 45° C. to 65° C. It is desirable to have at least part, though not all, the catalyst system present in the aqueous phase as the unsaturated copolymerizable materials are added thereto. The remainder of the catalyst system is either in admixture with the unsaturated copolymerizable materials as they are added to the emulsions or it can be added separately as an aqueous solution as polymerization proceeds; although in the preferred variation it is added during the course of polymerization by both methods simultaneously.

Any water-soluble vinyl polymerization catalyst can be employed in effecting polymerization. Peroxidic free-radical catalysts, particularly catalyst systems of the redox type, are generally employed. Such systems, as is well known, are combinations of oxidizing agents and reducing agents such as a combination of potassium persulphate and sodium bisulphite. Other suitable peroxidic agents include the "per-salts" such as the alkali metal and ammonium persulphates and perborates, hydrogen peroxide, organic hydroperoxides such as tert-butyl hydroperoxide and cumene hydroperoxide, and esters such as tert-butyl perbenzoate. Other reducing agents include water soluble thiosulphates and hydrosulphites and the salts, such as the sulphates, of metals which are capable of existing in more than one valence state such as cobalt, iron, nickel, and copper. The proportion of catalyst may be varied widely, one suitable range being 0.01% to 1.0%, preferably 0.10% to 0.35% by weight as based on the weight of the monomer mixture.

When polymerization catalysts of the persulphate type are used, they decompose to acidic products. Accordingly, it is preferred to maintain the pH in the range of 5.0 to 8.5 during polymerization with materials such as sodium bicarbonate, etc.

Emulsifiers persuant to conventional practice are usually required for the combination of monomers employed in the present invention and to maintain the formed polymeric emulsions in a stable dispersed form. Generally, the amount of emulsifying agent falls between about 0.1% and about 10% by weight of the mixture of monomers.

Typical emulsifying agents which may be used include such nonionic agents as the alkylphenoxypolyethoxyethanols containing 8 to 9 carbon atoms in the alkyl group and 7 to 100 oxyethylene groups, condensation products of a fatty alcohol and ethylene oxide having from 12 to 18 carbon atoms in the fatty alcohol chain and 7 to 100 oxyethylene groups or condensation products of polyethylene glycol and long chain fatty acids. Appropriate nonionic commercial compositions are illustrated by Triton X-405, Antarox CO-897 and Teric 16A29.

Suitable anionic emulsifying agents include the higher fatty alcohol sulphates such as sodium lauryl sulphate, alkylarylsulphonates, e.g. sodium dodecylbenzene sulphonate, higher alkyl sulphosuccinates, e.g. sodium dioctyl sulphosuccinate, alkylarylpolyethoxyethanol sulphates or sulphonates, e.g. sodium t-octylphenoxypolyethoxyethyl sulphate having 1 to 5 oxyethylene units, alkoxypolyethoxyethylsulphates, e.g. sodium lauryltriethoxyethyl sulphate, and sulphosuccinate half esters of nonylphenoxypolyethoxyethanols, etc. Appropriate anionic commercial compositions are Fenopon EP-110, Triton X-200, Alkanate 3SL3, Aerosol A-103, Aerosol OT, Gardilene S30 and Empicol LS30E.

Suitable cationic emulsifying agents include lauryl pyridinium chloride or alkyldimethylbenzylammonium chloride in which the alkyl group has from 8 to 18 carbon atoms, etc.

We prefer to use nonionic type emulsifying agents or blends thereof, wherein 1.0 to 8.0% preferably 3.0 to 6.0% by weight of the monomer mixture is used. However, it will be appreciated that in accordance with certain modes of application to textile materials (e.g. exhaustion) as are described hereinafter, the preparation of emulsions stabilized in part by ionic surfactants may be desirable in order to confer a particular charge on the emulsion particles. Alternatively, as mentioned hereinbefore, charged emulsions may be obtained by copolymerization of ionic or ionizable monomers.

The polyamines of the compositions of this invention have the formula C:

$$X—NH—A—Y \qquad (C)$$

wherein the symbol A represents alkyleneimine sequence as defined hereinabove; X is a monovalent radical selected from the group H, or an organic radical containing up to 20 carbon atoms; Y is an organic radical selected from the group consisting of —X, $$—Z—NH—A—X]_p,$$

or $$—W—NH—A]_qX$$

wherein A and X are as previously defined; Z is a polyvalent organic radical having a molecular weight of up to 10,000,000; W is a divalent organic radical having a molecular weight of up to 10,000; and p and q are numbers, the average value of which is in the range 1 to (M/100−1), wherein M is the number-average molecular weight of the polyamine C.

It will be appreciated that when $R_3$=H, the alkyleneimine sequences will be linear; whereas when $R_3$ is either H or A, random branching of the polyalkylene polyamine segments will occur. When $R_3$, X and Y are all H, the value of n is preferably at least 3, more preferably at least 4. When X and Y are both H and n has a value of 5 or less then $R_3$ is preferably H. It will also be appreciated that suitable polyamines of this invention may take the form of block or graft copolymers wherein the alkyleneimine sequences (A) represents blocks within the polymer backbone or alternatively are side-chain grafts on the polymer backbone according to the structures:

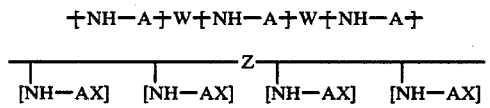

wherein A,W,X and Z are as above.

Examples of simple polyalkylene polyamines include, tetraethylene pentamine, pentaethylene hexamine, heptaethylene octamine, polyethylenimines of wide molecular weight range, N-(2-hydroxyethyl)-triethylene tetramine, N,N'-bis(2-hydroxyethyl)triethylene tetramine and the like. Amongst the higher polymeric polyamides which are suitable may be mentioned the polyamidoamines derived by condensation of polyalkylene polyamines with di or polybasic acids. Typical polycarboxylic acids which are suitable include glutaric acid, adipic acid, pimelic acid, suberic acid, azelaic acid, sebacic acid, isophthalic acid, terephthalic acid, betamethyladipic acid, 1,2, cyclohexane dicarboxylic acid, malonic acid and the like. An alternative range of suitable polyamines may be obtained by condensation of polyalkylene polyamines with polymers containing pendant (extralinear) or terminal reactive groups which are coreactive with primary or secondary amino groups. Amongst suitable reactive groups may be mentioned oxiranyl groups (e.g. glycidyl ether), allyl ether groups, carboxylic acid chloride groups, aldehyde groups, isocyanate groups, aziridinyl groups, halide groups, carboxyl groups etc. For example, especially suitable polyamines may be obtained by condensing isocyanate capped polyether polyols with polyethylene polyamines. Similarly, diglycidyl ethers of polyoxyalkylene diols or other polyols may be condensed with polyalkylene polyamines according to the teachings of U.S. Pat. No. 3,029,286 to form another especially useful range of polyamines.

An additional especially useful range of polyamines may be obtained by condensing acrylic or other vinyl copolymers containing extralinear glycidyl groups with polyalkylene polyamines to form graft copolymers.

An analogous range of graft copolymers containing polyalkylene polyamine branches may be obtained by cationic or anionic polymerization of aziridinyl compounds such as ethylenimine or propylenimine and the like, in the presence of a reactive backbone polymer. This is exemplified by U.S. Pat. No. 3,719,629 in which the substrate is an acrylic polymer containing extra-linear carboxyl groups as the grafting site.

In order to impart water-solubility or water-dispersability to the polyamine, it may be neutralized or partially neutralized by mixing with an acid in water or water miscible solvent or solvent blend. Among such solvents are the lower alkyl ethers of ethylene, propylene, dipropylene and like glycols representative of which are the butyl ether of propylene glycol, the ethyl ether of ethylene glycol, the propyl ether of diethylene glycol and an isobutyl ether of mixed propylene glycols. Other solvents will be known to those skilled in the art.

The useful acids are those that will form an acid salt with the amine moieties of the polyamine. Preferably the acid should be volatile and have a pKa greater than 3.0. Thus typical of the preferred species are formic and acetic acids. The less volatile acids such as glycolic acid, propionic acid, butyric acid and the like may be used but the wash resistance of the resulting polymer film is impaired. Inorganic acids such as phosphoric acid and hydrochloric acid may also be employed but are less preferred.

An alternative means of imparting water dispersability to the amine involves emulsification using appropriate surfactants and agitation. The procedure will be known to those skilled in the art.

The proportion of polyamine to the emulsion copolymer will naturally vary depending on the nature of the polyamine. The proportion of polyamine should be such that the proportion by weight of alkylene imine sequences as defined by formula A above be in the range 0.5 to 25%, preferably 1.0 to 15% of the combined nonvolatile content of emulsion copolymer and polyamine. When X, Y, $R_1$ and $R_2$ in the above formulae are all H and n has an average value greater than 6, then the proportion of polyamine is preferably 2 to 15%, more preferably 3 to 12% by weight of the combined nonvolatile content of emulsion copolymer and polyamine; and when n has an average value of 6 or less, then the proportion of polyamine is preferably from 3 to 25% by weight of the combined nonvolatile content of emulsion copolymer and polyamine.

The combined amount of oxirane containing copolymer and polyamine which is applied to the textile may range in concentration from 0.25 to 50% by weight of solid material on the textile. Where the textile material is a woven or knitted fabric, the preferred concentration range is 0.25 to 10% by weight. However, where the compositions of the invention are used for example to bind or fill non-woven materials or to coat woven or non-woven fabrics the preferred concentration range is from 10% to 50% by weight.

The liquors containing the compositions of the invention may be applied to the textile material by processes such as spraying, brushing, padding, dipping and the like. The compositions of the invention may also be applied to textile materials by exhaustion from long liquors.

One preferred technique of application involves immersing a textile material in a bath of the composition of the invention, then passing it through squeeze rolls so as to leave 30 to 100% by weight of the bath on the fabric and then drying to remove water and cure the composition. The combined amount of oxirane-containing copolymer and polyamine in the liquor to be applied to the textile may vary over a considerable range depending chiefly on the amount of polymer to be deposited and the pick-up allowed. For most applications a range of from 0.25 to 50% active ingredients would be used. The pH of the liquor may be varied within a considerable range. Generally very high and very low pH ranges should be avoided since degradation of the textile material can occur under extreme conditions. A pH range in general of 3.0 to 11.0 is suitable with a range of 4.0 to 10.0 being preferred for most applications. For polyamines having a molecular weight of less than 400, the preferred pH range is from 4.0 to 6.5, whereas a broad range of pH may be used with polyamines of higher molecular weight; although a range of from 7.0 to 10.0 is preferred when the average molecular weight of the polyamine exceeds 1,000. Since high molecular weight polyamines may act as flocculants for anionic emulsions, the maximum pH which may be used is that which is compatible with emulsion stability. The emulsion, however, may be stabilized at any particular pH by the addition of either cationic polyelectrolytes such as quaternary ammonium containing polymers, cationic surfactants such as cetyltrimethylammonium bromide or lauryl pyridinium chloride and the like, or electrolytes such as sodium sulphate or sodium chloride etc. In a preferred embodiment, however, the emulsion is stabilized where necessary by the addition of a volatile acid such as acetic or formic acids or others which were mentioned previously as suitable acids for forming a salt with the polyamine. Alternatively, when the stability of the emulsion is not endangered, the pH may be optionally raised by the addition of a suitable base. Suitable bases include amines which are either volatile or lack active hydrogen atoms such as ammonia; trimethylamine; triethylamine; dimethylaminoethanol; 2,4,6-tris-(dimethylaminomethyl)-phenol etc.; or inorganic bases such as sodium carbonate or sodium bicarbonate etc.

Another preferred technique in which the compositions of this invention may be applied to textile materials involves exhaustion from a long liquor. By long liquor we mean baths where the mass of liquor to textile material lies between 5:1 and 100:1. This method is particularly suited to treating knitted garments but may be used for treating very long lengths of textile materials in winches, dye vats, side paddles and the like. The textile material is agitated in a bath containing the composition at a pH such that there is a small positive zeta potential on the emulsion particles, the temperature being raised gradually to a value between 15° C. and 75° C. until such time as the bath is substantially clear. The range of suitable pH will generally be from 4.5 to 10.0 depending on the charge of the original copolymer emulsion particles. The effect of cationic polyelectrolytes such as the high molecular weight polyamines of the compositions of this invention is to make the charge on the particles more positive by surface adsorption. This charge may be defined in terms of the zeta potential, a quantity which may be measured by several means available to the art, e.g. by use of microelectrophoresis with the ultramicroscope. The actual zeta potential may be calculated by means of the Hemholtz-Smoluchowski equation. The zeta potential of the initial oxirane-containing copolymer emulsion is preferably negative or neutral, this being made positive upon admixture with the polyamines of this invention.

It is preferred that the zeta potential of the emulsion particles should not be excessively positive and, in a preferred embodiment, just sufficiently positive to maintain emulsion stability in the absence of the textile material. This may be achieved by pH control, e.g. a base will reduce the zeta potential and an acid increase it. The pH of the exhaust bath may be adjusted with any of the acids or bases previously mentioned. Although less preferred, modification to the zeta potential of the emulsion particles may also be achieved by the addition of interfacially-active ionic additives such as high molecular weight polyelectrolytes or surfactants. The preferred polyamines in exhaust application are those wherein the average value of n exceeds 100 or alternatively where the molecular weight exceeds 10,000, the polyethylenimines being especially preferred.

The rate of exhaustion of the compositions may be accelerated by the addition of up to 2 g/l of a nonionic surfactant or water soluble polymer. In the preferred case a nonionic surfactant which is essentially soluble in cold water and has a cloud point of less than 90° C. is used. Suitable nonionic surfactants include alkylphenoxypolyethoxyethanols containing 8 to 9 carbon atoms in the alkyl group and from 4 to 15 oxyethylene groups, alkoxypolyethoxyethanols containing from 9 to 18 carbon atoms in the alkyl group and from 4 to 15 oxyethylene groups, or various block copolymers of polyethyleneoxide and polypropylene oxide. Preferred nonionic water soluble polymers are those having an inverse solubility-temperature relationship in water, examples of which include polyvinylmethyl ether, polyisopropylacrylamide and cellulose methylethers. After the bath has essentially cleared (i.e. the compositions of the invention have exhausted onto the textile material), the textile materials are removed from the bath, dried and cured. Before drying it is usual practice to remove as much excess water as possible by, for example, squeezing, pressing or hydro-extracting.

The aqueous liquor in which the compositions of this invention are applied to textile materials may also carry in solution or emulsion form various compatible textile auxiliaries employed to modify the properties of the aqueous composition, the cured polymer or the impregnated textile. By way of example we cite wetting agents; emulsion (latex) particle coalescing aids; thermosensitizing coagulants; electrolytes; plasticizers; softeners and lubricants; handle modifiers; water, oil and soil repellents or proofing agents; flame retardants; dyes; pigments; optical brighteners; UV absorbers; setting agents; anti-crease and anti-slip agents and the like.

Subsequent to the application of the aqueous composition to the textile material, some or all of the water is evaporated prior to the curing operation. Such prior evaporation is not a critical step and the evaporation may be simply effected as part of the curing step. The temperature applied in the curing step is not critical and is usually within the range from 50° C. to about 150° C. It is obvious that the time required for curing will vary with such factors as the reactivity of the selected polyamine, the type of textile material, and particularly the temperature so that a lower curing temperature will require a longer curing time and vice versa. It will be further obvious to the skilled worker that in any particular case the temperature of curing should not be so high as to cause degradation of the textile. In many cases an adequate cure is affected by heating and treated textile in an oven at about 100° C. for about 1 to 60 minutes. The above ranges are indicative of suitable reaction conditions and are by no means considered limiting of the present invention.

The compositions of this invention display an unusual ability to improve the properties of textiles, particularly those composed of wool when the treatment is carried out at extremely low application levels. Accordingly, fine worsted fabrics which have hitherto been difficult to shrinkresist can now be treated without impairment to handle, thereby eliminating the need for subsequent softening procedures. Moreover, the proportion of oxidizable nitrogen containing material can be held at such a low level that yellowing or discoloration of the treated material is undetectable. It is a particular advantage of the compositions of this invention, that when applied to textile materials they are effectively cured under mild conditions. It is therefore a most unexpected aspect of this invention to discover that the aqueous compositions have an exceptionally long pot life which is in excess of several weeks at normal temperatures. The skilled worker will be aware that this aspect is exceedingly rare in mixtures of aliphatic polyamines and polyepoxides (see C. May and Y. Tanaka (eds): Epoxy Resins—Chemistry and Technology, Dekker, N.Y., 1973). Accordingly the components of the compositions of this invention may be mixed in large batches and stored until required. It has also been observed that the treated textiles exhibit reduced tendency to abrasion, creasing, wrinkling and improved permanent press properties, all of which are generally desirable.

The improvements in textile properties which result from the practice of this invention are not accompanied by any deleterious alteration to the subsequent dyeing properties of the textile material, nor does it promote soiling or affect its soil retention during washing. It is also found that the treatment retains its efficiency after repeated drycleaning cycles and on exposure to light, heat and normal ageing procedures.

It is important to note that the considerable improvement in textile properties are only provided by the compositions of this invention when the two essential components, i.e. oxirane-containing copolymer emulsion and polyamine are both present and in the proportions indicated. This finding was quite unexpected in view of the fact that the same improvements could not be obtained when the above-mentioned polyamines are substituted by other epoxy resin curing agents of conventional practice. Amongst the group of highly reactive polyamines which fail to provide the improvements in properties described hereinabove may be mentioned ethylenediamine; hexamethylenediamine; diethylaminopropylamine; menthanediamine; N-aminoethyl piperazine; polyoxyalkylenepolyamines, known as Jeffamines (Registered Trade Mark of Jefferson Chemical Co.), and a wide variety of aromatic polyamines. Other agents which are widely used to cure epoxy resins and polyglycidyl ethers etc. such as polymercaptans, polyphenols, polybasic acids, and the catalytic curing agents etc. (see "Epoxy Resins-Chemistry and Technology" by C. May and Y. Tanaka, Dekker, N.Y., 1973, p. 239) similarly fail to provide any apparent improvement in properties over those obtained by the oxirane-containing copolymer emulsion alone. It is believed that apart from acting to crosslink the oxirane-containing copolymers, the polyamine components of the compositions of this invention provide by some mechanism which is not understood, greatly increased substantivity to a variety of textile materials, and particularly those composed of wool or other keratinous fibres.

Although the present invention is of particular advantage in its application to wool, this is by no means the only type of fibre which comes into the ambit of the invention. Generically, the invention is applicable to the treatment of any textile material and this material may be in any physical form, e.g. bulk fibres, filaments, yarns, threads, slivers, roving, top, webbing, cord, tapes, woven or knitted fabrics, felts or other non-woven fabrics, garments or garment parts. Illustrative examples of textile materials to which the invention may be applied are:

Polysaccharide-containing textiles, for instance, those formed of or containing cellulose or regenerated celluloses, e.g. cotton, linen, hemp, jute, ramie, sisal, cellulose acetate rayons, cellulose acetatebutyrate rayons, saponified acetate rayons, viscose rayons, cuprammonium rayons, ethyl cellulose, fibres prepared from amylose, algins, or pectins; mixtures of two or more of such polysaccharide-containing textiles. Protein-containing textiles, for instance, those formed of or containing wool, silk, animal hair, mohair, leather, fur, regenerated protein fibres such as those prepared from casein, soybeans, peanut protein, zein, gluten, egg albumin, collagen, or keratins, such as feathers, animal hoof or horn. Mixtures of any two or more protein-containing textiles. Mixtures of polysaccharide-containing textiles, and protein-containing textiles, e.g. blends of wool and cotton; wool and viscose, etc. Textiles formed of or containing synthetic resins, e.g. alkyd resins, polyvinyl alcohol, partially esterified or partially etherfied polyvinyl alcohol, nylon, polyurethanes, polyethylene glycol terephthalate, polyacrylonitrile, polyethylene, polypropylene, polyvinyl chloride and polyvinylidene chloride. Blends of natural fibres such as cotton or wool with synthetic fibres such as nylon, polyethyleneglycol terephthalate, acrylonitrile, etc. Inorganic fibres such as as asbestos and glass fibres.

The teaching of this invention may also be applied for the purpose of obtaining other functional or decorative effects such as increasing gloss or transparency, and increasing adhesion or bonding characteristics of the substrates with rubber, polyester resins, etc.

To illustrate the manner in which the invention may be carried out, the following examples are given. It is to be understood, however, that the examples are for the purpose of illustration and the invention is not to be regarded as limited to any of the specific materials or conditions recited therein. Unless otherwise indicated, parts and percentages disclosed in the examples are parts and percentages by weight and temperatures are in degrees celsius.

The effectiveness of the compositions exemplified below in stabilizing wool was determined unless specified otherwise in the following test:

A plain weave worsted fabric (150 g/m$^2$) was impregnated with the aqueous compositions at room temperature on a laboratory pad mangle to give a wet pick up of 100%. The fabric was dried for 10 minutes at 85° and cured for 5 minutes at 125° in a forced draught oven. The treated samples together with sufficient polyester weighting squares to make up a load of 1 kg were washed in a 50 l Cubex International machine with 12.5 l wash liquor containing 0.2 g/l Antarox CO-630 (a nonylphenoxypolyethoxyethanol nonionic surfactant) at 40°. The area shrinkage quoted refers to wet dimensions measured after the samples had been relaxed in the above wash liquor for 30 minutes at 40° prior to washing. Untreated samples shrunk 72–75% after a 1 hour wash. Where alternative fabrics, conditions of application, or conditions of curing were employed, they are specified in the particular example.

The polymers prepared in subsequent examples were analysed for epoxide content by a volumetric method involving hydrochlorination and subsequent determination of the residual acid. Their glass-transition temperatures (Tg) were determined by Differential Scanning Colorimetry.

EXAMPLE 1

A. Preparation of an Emulsion copolymer having a monomer composition: 85% Butyl Acrylate, 10% 2-Hydryoxyethyl Acrylate, 5% Glycidyl Methacrylate.

An admixture of 552 parts of deionized water, 25 parts of Triton X-405 (a 70% solution of a commercially available octylphenoxypolyethoxyethanol nonionic surfactant), 3.1 parts of Fenopon EP-110 (a 30% solution of a commercially available sodium octylphenoxypolyethoxyethyl sulphate anionic surfactant) and 0.5 parts of sodium dihydrogen orthophosphate was prepared and charged to a glass reactor fitted for mechanical stirring, temperature control, reflux, nitrogen purging and continuous addition of monomer and initiator solutions in separate feeds. The mixture was heated to a temperature of 61° under a nitrogen atmosphere, then 10 parts of 0.4% ammonium persulphate followed by 8 parts of 0.9% sodium formaldehyde sulphoxylate were added. While stirring the mixture of 60°, a monomer feed composed of 340 parts of butyl acrylate, 40 parts of 2-hydroxyethyl acrylate, 20 parts of glycidyl methacrylate and 0.61 parts of t-butyl hydroperoxide; and an initiator feed composed of 50 parts of 0.8% sodium formaldehyde sulphoxylate were added simultaneously over 2.5 hours. The temperature was maintained at 55°–60° for a further 1.5 hours, after which the emulsion was cooled, filtered through cheesecloth and adjusted to a pH of 7.0 with sodium bicarbonate. The solids content of the emulsion was 39.5% and epoxide alalysis indicated 0.029 equivalents/100 g (calc. 0.033).

B. Preparation of a Polyamine from a Polyisocyanate and Triethylene Tetramine.

To a rapidly stirred solution of 20 parts of Synthappret LFK (a polyisocyanate with a polyether backbone, Mn 3600, having 3.6% isocyanate content, 80% solids) in 25 parts of ethanol was added an admixture containing 2 parts of triethylenetetramine, 12.2 parts of 2.23N aqueous HCl and 0.8 parts of ethanol. The resulting solution was miscible with water in all proportions and contained 20% solids.

C. A textile treatment bath was formulated with the following compositions:

Polymer of A above: 3.8% solids
Polyamine of B above: 0.2% solids
Teric G9A6 (an alkoxypolyethoxyethanol nonionic surfactant): 0.05%
Sodium Bicarbonate to give pH 6.0

Fabric samples treated with the above composition had a soft handle and showed an area shrinkage of 0% after a 3 hour wash. By contrast, when either Polymer A or Polyamine B were omitted from the bath, the area shrinkage of treated fabrics was in excess of 70%.

D. A textile treatment bath was formulated with the following composition:

Polymer of A above: 2.8% solids
Tetraethylene Pentamine: 0.2%
Teric G9A6: 0.1%
Acetic Acid to give pH 5.5

The treated samples had a soft handle and showed an area shrinkage of 0% in a 4 hour wash.

E. A textile treatment bath was formulated with the following composition:

Polymer of A above: 2.8% solids
PEI 1000 (a polyethyleneimine of molecular weight 50 to $100\times10^3$, 33% solution): 0.4% nonvolatile
Teric G9A6: 0.05%
Acetic acid to give pH 7.0

The handle of treated samples was soft and their area shrinkage was 0% after a 4 hour wash.

F. Textile treatment baths were formulated with the following compositions:

Polymer of A above: 1.9% solids
Polyamine (see below): 0.1%
Teric G9A5 (an alkoxypolyethoxyethanol nonionic surfactant): 0.03%
Acetic acid to give pH 8.0

The polyamines were polyethyleneimines of various molecular weights as follows:

| | Mn |
|---|---|
| PE1-3 | 300 |
| PE1-6 | 600 |
| PE1-12 | 1200 |
| PE1-18 | 1800 |

Fabric samples treated with the above solutions had a soft handle and showed 0% area shrinkage after a 4 hour wash.

COMPARATIVE EXAMPLE 1

A. An emulsion copolymer was prepared as in Example 1A except that N-methylol acrylamide was substituted for the glycidyl methacrylate. The emulsion had a solids content of 40%.

B. Textile treatment baths were formulated as in Example 1F above.

In all cases, the area shrinkage of treated samples exceeded 60% after a 1 hour wash.

EXAMPLE 2

A. Preparation of an Emulsion Copolymer having a Monomer composition: 80% Butyl Acrylate, 10% 2-Hydroxyethyl Acrylate, 10% Glycidyl Methacrylate.

An admixture of 605 parts of deionized water, 21.9 parts of Triton X-405 and 2.4 parts of Aerosol A-103 (a 34% solution of a commercially available disodium sulphosuccinate half ester of a nonylphenoxypolyethoxyethanol anionic surfactant) was prepared and charged to a glass vessel equipped as in Example 1A. The mixture was heated to a temperature of 60° under a nitrogen atmosphere, 0.04 parts of ammonium persulphate in 10 parts of deionized water was added, followed by 0.06 parts of sodium formaldehyde sulphoxylate in 8 parts of deionized water. To the heated mixture was added simultaneously with continuous stirring over a period of 2½ hours, two additional admixtures in separate streams. One of these was composed of 280 parts of butyl acrylate, 35 parts of 2-hydroxyethyl acrylate, 35 parts of glycidyl methacrylate and 0.54 parts of t-butyl hydroperoxide, whilst the other admixture contained a solution of 0.35 parts of sodium formaldehyde sulphoxylate and 0.5 parts of disodium hydrogen orthophosphate in 50 parts of deionized water. The resulting mixture was maintained at a temperature of 55° to 60° during this period and for 1½ hours thereafter. At the end of this time, the resulting emulsion was cooled, filtered through cheesecloth and adjusted to a pH of 7.0 with sodium bicarbonate. The solids content of the emulsion was 34.6% and epoxide analysis indicated 0.059 equivalents/100 g (calc. 0.066).

B. A textile treatment bath was formulated with the following composition:

Polymer of A above: 2.8% solids
Tetraethylene pentamine: 0.2%
Teric G9A5: 0.03%
Acetic Acid to pH 5.4

The treated fabric had a soft handle and showed 0% area shrinkage after a 3 hour wash.

C. A textile treatment bath was formulated as in B above, except that tetraethylene pentamine was replaced by Araldite Hardener HY-956, a proprietary composition of Ciba-Geigy Ltd. believed to be an alkylene oxide modified polyethylene polyamine having an amine nitrogen value of 23.5 to 27%.

The treated fabric had a soft handle and showed 0% area shrinkage in a 2 hour wash.

EXAMPLE 3

A. Preparation of an Emulsion Copolymer having a Monomer Composition: 85% Butyl Acrylate, 15% Glycidyl Methacrylate.

An admixture of 600 parts of deionized water, 15.3 parts of Teric N20 (a commercially available nonylphenoxypolyethoxyethanol nonionic surfactant), 2.4 parts of Aerosol A-103 and 0.7 parts of sodium bicarbonate was prepared and charged to a glass vessel equipped as in Example 1A. The mixture was heated to a temperature of 60° under a nitrogen atmosphere, then 0.04 parts of ammonium persulphate in 10 parts of deionized water was added, followed by 0.06 parts of sodium formaldehyde sulphoxylate in 8 parts of deionized water. To the heated mixture was added simultaneously with continuous stirring over a period of 2½ hours, two additional admixtures in separate streams. One of these was composed of 297.5 parts of butyl acrylate, 52.5 parts of glycidyl methacrylate and 0.54 parts of t-butylhydroperoxide, whilst the other stream was a solution of 0.36 parts of sodium formaldehyde sulphoxylate in 50 parts of deionized water. The resulting mixture was maintained at a temperature of 55° to 60° during this period and for 1½ hours thereafter. At the end of this time the emulsion was cooled and filtered through cheesecloth. It had a pH of 7.0 and a solids content of 35.3%. The polymer had a Tg of −43° C. and epoxide analysis indicated 0.095 equivalents/100 g (calc. 0.100).

B. A textile treatment bath was formulated as follows:

Polymer of A above: 2.7% solids
Pentaethylene hexamine: 0.3%
Teric G9A5: 0.03%
Acetic Acid to pH 5.3

The treated fabric had a soft handle and showed 0% area shrinkage after a 4 hour wash.

C. Textile treatment baths were prepared as in Example 1F. In all cases the treated fabric had a soft handle and showed 0% area shrinkage after a 5 hour wash.

COMPARATIVE EXAMPLE 3

A. A textile treatment bath was formulated as follows:

Polymer of Example 3A: 4.0% solids
Teric G9A5: 0.03%
Acetic Acid to pH 5.5

The treated fabric showed an area shrinkage of 68% after a 1 hour wash.

B. A series of textile treatment baths were formulated as in A above except that each of them contained one of the following polyamines at a concentration of 0.4% solids:

isophoronediamine
methanediamine
Trimethyl hexamethylenediamine methylene-bis-aniline
1,4 butane diamine
1,3 propane diamine
1,6 hexane diamine
N-aminoethyl piperazine
diethylaminoethylpropylamine
2,4,6-tris(dimethylaminomethyl)phenol, (DMP-30, Rohm & Haas)
piperidine
diethanolamine
triethylene diamine (DABCO, Air Products and Chemical)
4-dodecyl diethylene triamine
Dimer Diamine (General Mills)
Dimer Tetramine (General Mills)
Dow Experimental Curing Agent XD-7080
Jeffamines T-403, D-400, D-230 (polyoxypropylene diamines and triamines, Jefferson Chemical)
ethylenediamine
diethylenetriamine In all cases the area shrinkage of treated fabrics exceeded 65% after a 1 hour wash. The treatments were similarly unsatisfactory when the concentration of the polyamines in the bath was raised to 1.0%. Other potential crosslinking agents such as polybasic acids, polymercaptans, $BF_3$-amine and $BF_3$-ether complexes, and metal salts (such as zine fluoborate) were found to be similarly ineffective.

EXAMPLE 4

A. Preparation of an Emulsion Copolymer having a Monomer Composition: 65% Butyl Acrylate, 25% Ethyl Acrylate, 10% Glycidyl Methacrylate.

An admixture of 500 parts of deonized water, 25 parts of Triton X-405, 3.1 parts of Fenopon EP-120 and 0.6 parts of sodium bicarbonate was prepared and charged to a glass reactor equipped as in Example 1A. The mixture was heated to a temperature of 60° under a nitrogen atmosphere, then 10 parts of 0.5% ammonium persulphate followed by 8 parts of 1% sodium formaldehyde sulphoxylate were added. While stirring the mixture at 60°, a monomer feed composed of 260 parts of butyl acrylate, 100 parts of ethyl acrylate, 40 parts of glycidyl methacrylate and 0.72 parts of t-butyl hydroperoxide; and an initiator feed composed of 60 parts of 1% sodium formaldehyde sulphoxylate were added simultaneously over 2.5 hours. The temperature was maintained at 55°-60° for a further 2 hours, after which the emulsion was cooled, and filtered through cheesecloth. It had a pH of 7.4 and a solids content of 41%. The polymer had a Tg of −36° C. and epoxide analysis indicated 0.062 equivalents/100 g (calc. 0.066).

B. A textile treatment bath was formulated with the following composition:

Polymer A above: 2.8% solids
Polyamine (see below): 0.2%
Teric G9A6: 0.1%
Acetic Acid to give pH 5.5

The polyamines used in each formulation together with the resulting area shrinkage after a 4 hour wash are indicated in Table 1.

TABLE 1

| Polyamine | Area Shrinkage (%) |
|---|---|
| Pentaethylene hexamine | 0 |
| tetraethylene pentamine | 0 |
| Araldite Hardener HY-956 | 1 |
| Polyamine of Example 1B | 3 |

TABLE 1-continued

| Polyamine | Area Shrinkage (%) |
|---|---|
| PEI 1000* | 0 |
| Polyamine HPA No. 2 (a polyethylene polyamine, av. molecular weight 260) | 0 |
| PEI 3 (a polyethyleneimine, av. molecular weight 300) | 0 |

*used at 0.4% amine level since flocculation occurred at lower-concentrations.

By comparison, when suitable polyamines such as those of Table 1 (i.e. polyethylene polyamine types) were substituted by other polyamines commonly used as curing agents for epoxy resins, e.g. m-phenylenediamine, 4,4'-diaminodiphenylmethane, 1,6 hexane diamine, menthane diamine, isophorone diamine or tris 2,4,6(dimethylaminomethyl)phenol; there was no effective dimensional stabilization, i.e. >70% area shrinkage under the same conditions.

C. Preparation of an oxirane-substituted acrylic copolymer in isopropanol solution and subsequent condensation with a polyalkylene polyamine to form a graft copolymer.

To a glass reactor fitted for mechanical stirring, temperature control, reflux, nitrogen purging and continuous monomer addition, 200 parts of isopropanol were charged and heated to 82°-83° C. The following mixture was then added over a 2.5 hour period: butyl acrylate, 280 parts; ethyl acrylate, 40 parts; glycidyl methacrylate, 80 parts; and benzoyl peroxide, 8 parts. The mixture was stirred at 80° C. for a further 3 hours after which time it contained 66.2% solids (calculated 67.1%).

A miture containing the above oxirane-substituted copolymer solution, 308 parts; pentaethylenehexamine, 35 parts; and isopropanol, 653 parts was stirred at 55° for 30 minutes. At the end of this time it was cooled and 190 parts of 10% formic acid and 790 parts of water were added. A clear yellow solution resulted having a solids content of 12.6% and pH in the range 6.5-7.5.

D. Textile treatment baths were formulated with the compositions (1) and (2) as follows:

| | (1) | (2) |
|---|---|---|
| Polymer of A above | 2% solids | 1% solids |
| Polyamine engrafted copolymer of C above | 1% solids | 2% solids |
| Teric G9A6 | 0.1% | 0.1% |

Samples of wool fabric which were treated with either of these baths showed 0% area shrinkage after a 3 hour test.

EXAMPLE 5

A. Preparation of an emulsion copolymer having a monomer composition: 65% Butyl Acrylate, 25% Ethyl Acrylate, 10% Glycidyl Methacrylate (Nonionic).

The procedure used was essentially identical to that of Example 4A except that a nonionic emulsifier system was employed consisting of 24.7 parts of Triton X-405 and 4.3 parts of Teric N-10 (a commercially available nonylphenoxypolyethoxyethanol surfactant). The emulsion had a pH of 7.5 and a solids content of 41%. The polymer had a Tg of −36° C. and epoxide analysis indicated 0.063 equivalents/100 g (calc. 0.066).

It is generally found that a nonionic emulsifier system is preferable to the anionic system of Example 4A when using high molecular weight (>20,000) polyethyleneimines as the polyamine since a stable emulsion can be achieved over a much wider range of polyethylenimine concentrations in the treatment bath.

B. A textile treatment bath was formulated as follows:

Polymer of A above: 3.8% solids

PEI-1000: 0.2% nonvolatile

Teric N-8 (a nonylphenoxypolyethoxyethanol nonionic surfactant): 0.1%

Acetic Acid to pH 8.0

An all wool serge fabric of 345 g/m$^2$ was impregnated with the aqueous composition in a pad mangle to give a wet pick up of 50%. The fabric was dried and cured in a laboratory stenter for 3 minutes at 150°. The properties of the treated fabric compared to those of an untreated control are indicated in Table 2.

TABLE 2

| | Polymer pick-up %, owf | Flexural Rigidity μNm | AATC Durable Press Rating | Area Shrinkage/3 hour Cubex Test, % |
|---|---|---|---|---|
| Treated | 2.0 | 36 | 4–5 | 0 |
| Untreated | 0 | 22 | 3 | 8 |

C. An all wool shirting fabric of 150 g/m$^2$ was impregnated with a bath formulated as in B above and padded to give a wet pick-up of 50%. It was then dried and cured in a laboratory stenter for 3 min at 150°. The properties of the treated sample compared to those of an untreated control are given in Table 3.

TABLE 3

| | Polymer pick-up %, omf | Flexural Rigidity μNm | AATC Durable Press Rating | Area Shrinkage/3 hour Cubex Test, % |
|---|---|---|---|---|
| Treated | 2.0 | 12 | 2 | 1 |
| Untreated | 0 | 11 | 1 | 51 |

D. A plain weave worsted fabric of 150 g/m$^2$ was impregnated in a bath composed as in B above and padded to give a wet pick up of 50%. After drying and curing in a laboratory stenter for 3 minutes at 150°, the sample which contained 2.0% polymer omf was tested in a Martindale abrasion machine. The result together with that of an untreated sample is indicated below:

Treated: 6,400 rubs to fail

Untreated: 1,250 rubs to fail

The treated sample shows 0% area shrinkage in a 4 hour wash compared to >80% for an untreated control.

E. Textile treatment baths were formulated as in Example 1F except that the polymer of A above was employed. Fabric samples treated as in Example 1F had a soft handle and showed an area shrinkage of 0% in a 5 hour wash.

F. Textile treatment baths were formulated with the following compositions:

Polymer of A above: 1.9% solids

Polyamine (see below): 0.1% nonvolatile

Teric G9A5: 0.03%

Acetic Acid to give pH 8.0

The various polyamines employed with their respective molecular weight ranges as indicated by the manufacturer (Dow Chemical Co.) are as follows:

| | Mn |
|---|---|
| PEI 200 (supplied as 33% solution) | 20,000 to 30,000 |
| PEI 400 (supplied as 50% solution) | 30,000 to 40,000 |
| PEI 600 (supplied as 33% solution) | 40,000 to 60,000 |

The treated samples had a soft handle and showed an area shrinkage of 0% after a 5 hour wash.

Examples G to M illustrate the application of the polymer of A above by means of exhaustion from long liquors.

G. A textile treatment bath was formulated with the following composition:

Polymer of A above: 0.1% solids (3% omf)

PEI-1000: 0.005% nonvolatile (0.15% omf)

Teric N-8: 0.003%

Sodium Carbonate to pH 9.0

A plain weave worsted fabric weighing 33.3 g was circulated through the liquor containing 1000 g by means of a laboratory winch, thereby maintaining adequate circulation in the bath. Upon pH adjustment with sodium carbonate, the solution was heated slowly over a period of about 30 minutes to 60° C. during which it became substantially clear. The fabric was then removed, spun in a centrifuge to remove excess water and cured in a laboratory stenter for 3 minutes at 150°.

The treated fabric had a soft handle and showed 3% area shrinkage after a 3 hour wash, compared with >80% for an untreated control.

H. A textile treatment bath was formulated with the following composition:

Polymer of A above: 0.1% solids (i.e. 3% omf)

PEI-1000: 0.01% nonvolatile (i.e. 0.3% omf)

Teric N-8: 0.08%

A plain weave worsted fabric weighing 33.3 g was circulated through 1000 g of the above liquor by means of a laboratory winch. The bath was heated to 60° and held at this temperature until the liquor was substantially clear (about 30 minutes). The fabric was then centrifuged to remove excess water and cured in a laboratory stenter for 3 minutes at 150°. The treated fabric had a soft handle and showed 5% area shrinkage in a 3 hour wash, compared with >80% for an untreated control.

I. A textile treatment bath was formulated with the following composition:

Polymer of A above: 0.10% solids (i.e. 3% omf)

Polymin P (a high molecular weight polyethylenimine (BASF)): 0.01% nonvolatile (i.e. 0.3% omf)

Teric N-8: 0.10%

A sample of wool fabric was treated essentially as in H above with similar results.

J. The bath of a laboratory dyeing machine containing 300 g of liquor and 10 g of plain weave worsted fabric was composed as follows:

Polymer of A above: 0.1% solids (i.e. 3% omf)

Polymin P: 0.005% nonvolatile (i.e. 0.15% omf)

Teric N-8: 0.003%

Ammonia: 0.015%

The fabric was agitated within the bath which was heated to 50° over a period of 30 minutes during which it became substantially clear. After hydroextracting and curing the fabric as in G above, it had a soft handle and showed 3% area shrinkage after a 3 hour wash compared with >80% for an untreated control.

K. A textile treatment bath was formulated with the following composition:

Polymer of A above: 0.1% solids (i.e. 3% omf)
Polymin P: 0.007% nonvolatile (i.e. 0.2% omf)
PE1-6: 0.003% (i.e. 0.1% omf)
Teric N-8: 0.005%
$NaHCO_3$: 0.02%

A plain weave worsted wool fabric weighing 33.3 g was circulated through 1000 ml of the above liquor by means of a laboratory winch. The bath was heated to 60° over 30 minutes during which it became substantially clear. Fabric samples cured as in G above showed 4% area shrinkage, whilst untreated controls shrank >80%.

L. The bath of a laboratory side paddle apparatus was formulated with the following composition:

Polymer of A above: 0.080% solids (i.e. 2% omf)
Polymin P: 0.008% nonvolatile (i.e. 0.2% omf)
Teric N-8: 0.05%

The bath contained 10 liters of liquor and 400 g of a knitted Shetland wool fabric (cover factor 1.05) in the form of 15 cm square pieces. While the contents were agitated by means of the side paddle, the temperature was raised to 60° over 30 min. during which the liquor became clear. After hydroextraction and curing for 3 minutes at 150° in a laboratory stenter, the treated samples showed 0% area shrinkage in a 3 hour wash compared with 15% for an untreated control.

M. The bath of a laboratory dyeing machine containing 300 g of liquor and 10 g of a plain weave worsted fabric was composed as follows:

Polymer of A above: 0.1% solids (i.e. 3% omf)
Polymin P: 0.015% nonvolatile
Methocel A4M (a cellulose methyl ether, DOW): 0.007%
Teric N8: 0.003%

The fabric which was treated essentially as in J above had a soft handle and showed 6% area shrinkage after a 3 hour wash compared with >80% for an untreated control.

COMPARATIVE EXAMPLE 5

A. Textile treatment baths were prepared as in Comparative Examples 3A and 3B except that the polymer of Example 5A was substituted for the polymer of Example 3A. In all cases, it was found that the area shrinkage of treated samples exceeded 60% in a 1 hour test.

B. Textile treatment baths were prepared as in Comparative Example 3B except that the polymer of Example 5A was substituted for the polymer of Example 3A and the polyamine concentration was increased to 1%. With the exception of the diethylenetriamine treatment, area shrinkage of treated samples exceeded 60% in a 1 hour wash. The fabric sample treated in the bath containing 1.0% diethylenetriamine showed 33% area shrinkage after a 1 hour wash.

C. Textile treatment baths were prepared as in Example 5F except that the polymer of 5A was replaced by the commercial polyacrylate Primal K-3 (Rohm & Haas) which has been used previously for promoting shrinkresistance in wool. The product is a 46% solids emulsion and is believed to contain N-methylol amide functionality.

The area shrinkage of treated samples was 75% after a 3 hour test. The polymer was similarly ineffective when cured according to the manufacturers' recommendations using ammonium chloride as catalyst.

No improvement was obtained when other commercial polyacrylates such as Primal resins TR-934, HA-8 or K-87 were substituted for Primal K-3 in the above test.

EXAMPLE 6

A. Preparation of an Emulsion Copolymer having a Monomer Composition: 85% Butyl Acrylate, 15% Glycidyl Acrylate.

An admixture of 350 parts of deionized water, 9.2 parts of Triton X-405, 16 parts of 0.1% $FeSO_4.7H_2O$, 4.4 parts of 1.0% ethylenediamine tetraacetic acid disodium salt (EDTA), 68 parts of butyl acrylate, 12 parts of glycidyl acrylate and 0.2 parts of 80% t-butylhydroperoxide was emulsified in a glass reactor equipped as in Example 1A. The mixture was heated to 50° and then 16 parts of 1.0% sodium formaldehyde sulphoxylate and 4.5 parts of Triton X-405 were added. Then with the temperature at 55°, 50 parts of 1.0% sodium formaldehyde sulphoxylate and a separate pre-emulsion feed consisting of 65.5 parts of water, 0.8 parts of 80% t-butylhydroperoxide, 13.7 parts of Triton X-405, 272 parts of butyl acrylate and 48 parts of glycidyl acrylate was added simultaneously over a 3 hour period. The emulsion was held at 60° for a further 1½ hours after which it was cooled and filtered through cheese cloth. It had a pH of 3.5 and a solids content of 43%. Analysis for epoxide indicated 0.098 equivalents/100 g (calc. 0.106).

B. Textile treatment baths were formulated as in Example 1F. The fabric samples treated in this way had a soft handle and showed 0% area shrinkage after a 5 hour wash.

C. Textile treatment baths were formulated as in Example 5F. The fabric samples treated in this way had a soft handle and showed 0% area shrinkage after a 5 hour wash.

EXAMPLE 7

A. Preparation of an Emulsion Copolymer having a Monomer Composition: 95% Butyl Acrylate, 5% Glycidyl Acrylate.

To an admixture consisting of 333 parts of water, 0.75 parts of $NaHCO_3$, 4.8 parts of Triton X-405, 16 parts of 0.1% $FeSO_4.7H_2O$ and 4.4 parts of 1.0% EDTA in a glass reactor equipped as in Example 1A, was added 114 parts (20%) of a pre-emulsion consisting of 147 parts of water, 23.3 parts of Triton X-405, 1.0 parts of 80% t-butyl hydroperoxide, 380 parts of butyl acrylate and 20 parts of glycidyl acrylate. The temperature was raised to 50° whereupon 16 parts of 1.0% sodium formaldehyde sulphoxylate and 4.2 parts of Triton X-405 were added. Then, with the temperature at 55°, the remainder of the pre-emulsion of above (457.3 parts) and 50 parts of 1.0% sodium formaldehyde sulphoxylate were simultaneously added in separate feeds over a 3 hour period. The emulsion was maintained at 55° for a further 1½ hours, after which it was cooled and filtered through cheesecloth. It had a pH of 8.0 and a solids content of 42%. Epoxide analysis indicated 0.036 equivalents/100 g (calc. 0.037).

B. The polymer was tested in the textile treatment baths formulated in Examples 1F and 5F with the same result.

COMPARATIVE EXAMPLE 7

A. An emulsion copolymer was prepared as in Example 7A except that N-methylol acrylamide was substituted for the glycidyl acrylate. It had a solids content of 42%.

B. The polymer was tested in the textile treatment baths formulated in Examples 1F and 5F but in all cases the area shrinkage of treated textiles after washing for 1 hour exceeded 60%.

EXAMPLE 8

Preparation of an Emulsion Copolymer having a Monomer Composition: 82% Butyl Acrylate, 15% Glycidyl Acrylate, 3% Trimethylammoniumethyl methacrylate methosulphate (quaternary monomer).

An admixture of 413 parts of water, 11.4 parts of Triton X-405, 16 parts of 0.1% $FeSO_4.7H_2O$, 4.4 parts of 1.0% EDTA, 0.6 parts of $NaHCO_3$, 0.2 parts of 80% t-butyl hydroperoxide, 67.6 parts of butyl acrylate and 12.4 parts of glycidyl acrylate was emulsified in a glass reactor equipped as in Example 1A. The mixture was heated to 50° and then 16 parts of 1.0% sodium formaldehyde sulphoxylate and 11.4 parts of Triton X-405 were added. Then with the temperature at 55°, 50 parts of 1.0% sodium formaldehyde sulphoxylate and a separate pre-emulsion feed consisting of 111.8 parts of water, 11.4 parts of Triton X-405, 0.8 parts of 80% t-butyl hydroperoxide, 260.4 parts of butyl acrylate, 47.6 parts of glycidyl acrylate and 30 parts of a 40% solution of trimethylammoniumethyl methacrylate methosulphate were added over a period of 3 hours. The emulsion was held at 55° for a further 1½ hours after which it was cooled and filtered through cheese cloth. It had a solids content of 40% and a pH of 7.5. Epoxide analysis indicated 0.089 equivalents/100 g (calc. 0.110).

B. A textile treatment bath was composed as follows:

Polymer of A above: 1.9% solids

PEI-1000: 0.1% nonvolatile

Teric G9A5: 0.03%

The bath had a pH of 9.1

Fabric samples treated with this liquor had a soft handle and showed 0% area shrinkage after a 3 hour wash.

C. A textile treatment bath was formulated as in B above except that 0.015% acetic acid was included with the result that the treatment bath had a pH of 8.1. The dimensional stability of treated samples was similar to those treated in B above.

EXAMPLE 9

Preparation of an Emulsion Copolymer having a Monomer Composition: 85% Butyl Acrylate, 10% Glycidyl Methacrylate, 5% Trimethylammoniumethyl Methacrylate Methosulphate (Quaternary Monomer).

An admixture consisting of 360.9 parts of water, 11.4 parts of Triton X-405, 16 parts of 0.1% $FeSO_4.7H_2O$, 4.4 parts of 1.0% EDTA, 0.6 parts of $NaHCO_3$, 0.2 parts of 80% t-butyl hydroperoxide, 71.6 parts of butyl acrylate and 8.4 parts of glycidyl methacrylate was emulsified in a glass reactor equipped as in Example 1A. The mixture was heated to 50° and then 16 parts of 1.0% sodium formaldehyde sulphoxylate and 11.4 parts of Triton X-405 were added. Then with the temperature at 55°, 42 parts of sodium formaldehyde sulphoxylate and a separate pre-emulsion feed consisting of 94.9 parts of water, 11.4 parts of Triton X-405, 0.8 parts of 80% t-butyl hydroperoxide, 0.05 parts of $NaHCO_3$, 268.4 parts of butyl acrylate, 31.6 parts of glycidyl methacrylate and 50 parts of a 40% solution of trimethylammoniumethyl methacrylate methosulphate were added over a period of 3 hours. The emulsion was held at 55° for a further 1½ hours after which it was cooled and filtered through cheese cloth. It had a solids content of 42% and a pH of 7.6. Epoxide analysis indicated 0.050 equivalents/100 g (calc. 0.066).

B. Textile treatment baths were formulated according to Examples 7B and 7C. The dimensional stability of treated samples was similarly very good. The polymer was shown to be similarly effective when tested according to the formulation of Example 1F.

EXAMPLE 10

A. Preparation of an Emulsion Copolymer having a Monomer Composition: 25% Butyl Acrylate, 65% Ethyl Acrylate, 10% Glycidyl Methacrylate.

To an admixture consisting of 405.7 parts of water, 0.5 parts of $NaHCO_3$, 8.3 parts of Triton X-405, 16 parts of 0.1% $FeSO_4.7H_2O$ and 4.4 parts of 1.0% EDTA in a glass reactor equipped as in Example 1A, was added 97.8 parts (20%) of a pre-emulsion consisting of 75.5 parts of water, 12.3 parts of Triton X-405, 1.0 parts of 80% t-butyl hydroperoxide, 100 parts of butyl acrylate, 260 parts of ethyl acrylate and 40 parts of glycidyl methacrylate. The temperature was raised to 45° whereupon 16 parts of 1.0% sodium formaldehyde sulphoxylate and 10.3 parts of Triton X-405 were added. Then, with the temperature at 55°, the remainder of the pre-emulsion of above (391 parts) and 50 parts of 1.0% sodium formaldehyde sulphoxylate were added simultaneously in separate feeds over a 3 hour period. The emulsion was maintained at 55° for a further 1½ hours, after which it was cooled and filtered through cheesecloth. It had a solids content of 42% and a pH of 8.4. Epoxide analysis indicated 0.061 equivalents/100 g (calc. 0.066).

B. Textile treatment baths were formulated according to Example 1F and 5F. The dimensional stability of treated samples was similarly very good.

EXAMPLE 11

A. Preparation of an Emulsion Copolymer containing 10% Butyl Acrylate, 80% Ethyl Acrylate, 10% Glycidyl Methacrylate.

To an admixture consisting of 325.3 parts of water, 0.3 parts of $NaHCO_3$, 8.3 parts of Triton X-405, 16 parts of 0.1% $FeSO_4.7H_2O$ and 4.4 parts of 1.0% EDTA in a glass reactor equipped as in Example 1A was added 114.3 parts (20%) of a pre-emulsion consisting of 156.1 parts of water, 14.3 parts of Triton X-405, 1.0 parts of 80% t-butyl hydroperoxide, 40 parts of butyl acrylate, 320 parts of ethyl acrylate and 40 parts of glycidyl methacrylate. The temperature was raised to 45° whereupon 16 parts of 1.0% sodium formaldehyde sulphoxylate and 8.3 parts of Triton X-405 were added. Then, with the temperature at 55°, the remainder of the pre-emulsion of above (457.1 parts) and 50 parts of 1.0% sodium formaldehyde sulphoxylate were added simultaneously in separate feeds over a 3 hour period. The emulsion was maintained at 55° for a further 1½ hours after which it was cooled and filtered through cheesecloth. It had a solids content of 42% and a pH of 8.0. Epoxide analysis indicated 0.062 equivalents/100 g (calc. 0.066).

B. Textile Treatment baths were formulated according to Examples 1F and 7C. The dimensional stability of treated fabrics was similarly very good.

EXAMPLE 12

A. Preparation of an Emulsion Copolymer containing 68% Butyl Acrylate, 20% Ethyl Acrylate, 10% Glycidyl Methacrylate and 2% 2-Sulfoethyl Methacrylate, Sodium Salt.

To an admixture consisting of 329.4 parts of water, 10.6 parts of Triton X-405, 0.07 parts of $NaHCO_3$, 16 parts 0.1% $FeSO_4.7H_2O$ and 4.4 parts of 1.0% EDTA in a glass reactor equipped as in Example 1A was added 113 parts (20%) of a pre-emulsion consisting of 12 parts of Triton X-405, 1.0 parts of t-butyl hydroperoxide, 0.15 parts of $NaHCO_3$, 272 parts of butyl acrylate, 80 parts of ethyl acrylate, 40 parts of glycidyl methacrylate and 160 parts of a 5% aqueous solution (pH 3.6) of 2-sulfoethylmethacrylate sodium salt. The temperature was raised to 45° whereupon 16 parts of sodium formaldehyde sulphoxylate and 8.3 parts of Triton X-405 were added. Then, with the temperature at 55°, the remainder of the pre-emulsion of above (452 parts) and 50 parts of 1.0% sodium formaldehyde sulphoxylate were added simultaneously in separate feed over a period of 2½ hours. The emulsion was maintained at 55° for a further 1½ hours after which it was cooled and filtered through cheesecloth. It had a solids content of 42% and pH of 6.8. Epoxide analysis indicated 0.051 equivalents/100 g (calc. 0.066).

B. Textile treatment baths were formulated according to Example 1F. The dimensional stability of treated samples was similarly very good.

EXAMPLES 13 & 14

A. Emulsion copolymers having the following compositions and properties were prepared according to the procedure of Example 11.

| | Composition | Solids % | Epoxide Content (equiv./100 g) |
|---|---|---|---|
| Example 13 | BA/AN/GMA 80:10:10 | 42 | 0.060 |
| Example 14 | BA/MMA/GMA 70:20:10 | 42 | 0.062 |

wherein

BA is butyl acrylate
GMA is glycidyl methacrylate
MMA is methyl methacrylate
AN is acrylonitrile B. The polymers were tested according to the formulations of Examples 1F and 7C with similarly excellent results.

C. A textile treatment bath was prepared having the following composition:

Polymer of 14A above: 1.9% solids
PEI-1000: 0.1% nonvolatile
GAFQUAT 755 (a partially quaternized polyvinyl pyrrolidone, GAF): 0.1% solids
Teric G9A5: 0.05%
The bath had a pH of 9.2

The treated samples had a soft handle and showed an area shrinkage of 0% after a 9 hour wash.

A similarly high degree of dimensional stability was obtained when the polymers of Examples 5A, 6A, 11A and 13A were substituted for the polymer of Example 14A in the above bath.

Those skilled in the art will appreciate that the invention described herein is susceptible to variations and modifications other than those specifically described. It is to be understood that the invention includes all such variations and modifications which fall within its spirit and scope.

EXAMPLE 15

A series of emulsion polymers varying in backbone composition was prepared at approximately 44% solids using a procedure similar to that of Example 11. Treatment baths were then formulated containing each of the polymers at various concentrations, a polyethylenimine of average molecular weight 600 and acetic acid, the latter both at a concentration of 3% on mass of polymer (omp). Sufficient wetting agent (i.e. 0.03% Teric G9A5) was included and the liquors were padded on to the wool fabric at 50% expression giving a dry add-on in the range 0.6 to 2.0% owf.

The treated fabrics were assessed by (i) the number of hours of washing in which area shrinkage was limited to no more than 10% (hours survived) at a treatment level of 2% polymer owf and (ii) the minimum effective treatment level (METL) which similarly limited area shrinkage in a 3 hour wash.

The results for the series of polymers which are grouped according to their approximate glass transition temperatures (Tg) are shown in Table 4.

TABLE 4

| Polymer[a] | Composition | Hours Survived[b] | METL[c] |
|---|---|---|---|
| Tg −40° (approx.) | | | |
| BA/BMA/GMA | 78:12:10 | 16 | 1.2 |
| BA/EA/GMA | 65:25:10 | 14 | 1.3 |
| BA/AN/GMA | 80:10:10 | 13 | 1.3 |
| BA/2EHMA/GMA | 70:20:10 | 9 | 1.4 |
| 2EHMA/BMA/GMA | 50:40:10 | 8 | 1.5 |
| 2EHA/MMA/GMA | 62:28:10 | 8 | 1.5 |
| 2EHA/2EHMA/GMA | 40:50:10 | 5 | 1.7 |
| Tg −18° | | | |
| BA/BMA/GMA | 46:44:10 | 18 | 1.1 |
| BA/BMA/GMA | 46:46.5:7.5 | 15 | 1.2 |
| EA/GMA | 90:10 | 5 | 1.7 |
| Tg −13° | | | |
| BA/BMA/GMA | 40:50:10 | 22 | 1.0 |
| BA/S/GMA | 60:30:10 | <3 | >>2 |
| Tg −5° | | | |
| BA/BMA/GMA | 30:60:10 | 33 | 0.9 |
| 2EHMA/GMA | 90:10 | 15 | 1.2 |
| BA/MMA/GMA | 54:36:10 | 16 | 1.2 |
| EA/MMA/GMA | 76:14:10 | 4 | 1.8 |

[a]Code:
BA butyl acrylate
2EHA 2-ethylhexyl acrylate
EA ethyl acrylate
MMA methyl methacrylate
BMA butyl methacrylate
2EHMA 2-ethylhexyl methacrylate
AN acrylonitrile
S styrene
GMA glycidyl methacrylate
[b]Number of hours of washing at which area shrinkage was limited to 10% when fabrics were treated at 2% owf.
[c]Minimum effective treatment level necessary to limit area shrinkage to 10% in a 3 hour wash.

EXAMPLE 16

A series of emulsion polymers of varying epoxide content was prepared at approximately 44% solids using a procedure similar to that of Example 11. Treatment baths were prepared as in Example 15 and the polymers were applied to wool fabric as before. The results obtained for various polymer compositions are indicated in Table 5.

TABLE 5

| BA/BMA/GMA Ratio | Measured Epoxide Content (Eq/Kg) | Hours Survived | METL |
|---|---|---|---|
| 49:51:0 | 0 | 0 | >8 |
| 49:46:5 | 0.29 | 7 | 1.4 |
| 49:41:10 | 0.59 | 17 | 1.1 |
| 49:36:15 | 0.89 | 24 | 1.0 |
| 49:31:20 | 1.19 | 18 | 1.1 |
| 49:26:25 | 1.50 | 16 | 1.1 |
| 49:21:30 | 1.79 | 10 | 1.3 |

Some of the textile treatments falling within the scope of the present invention include the following:

(i) bonding of non-woven textiles
(ii) lamination of textiles
(iii) fibre floccing of textiles and other substrates
(iv) pigment dyeing or pigment printing of textiles, and
(v) coating or impregnating of textiles.

I claim:

1. A textile material when treated by a composition comprising an admixture of:

(a) an aqueous emulsion of a copolymer of a monomeric mixture consisting essentially of an oxirane-containing monoethylenically-unsaturated material and at least one other monethylenically-unsaturated material selected from the group characterized by the formula

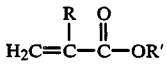

wherein R is H or $C_1$ to $C_4$ alkyl and R′ is a straight chain or branched chain radical of a primary or secondary alkanol, alkoxyalkanol or alkylthiaalkanol having up to 14 carbon atoms, and (b) a water soluble or water dispersible polyamine which is composed of at least 4 alkylenimine units (—CH—CH—N—) which occur in sequences of such alkylenimine units having the formula A

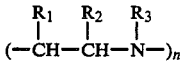

(A)

wherein $R_1$ and $R_2$ are independently selected from hydrogen, and lower alkyl radicals of 1 to 4 carbon atoms, $R_3$ is H or other alkylenimine sequences of formula A, and n is a number which has an average value of at least 2, wherein the admixture (a) and (b) is further characterized in that it exists as a stable emulsion at a pH in the range 3 to 11 and wherein the proportion of polyamine (b) is such that the sequences of alkylenimine units of formula A represent from 0.5% to 25% by weight of the non-volatile material in the combined mass of the emulsion copolymer and polyamine.

2. A textile material according to claim 1 wherein said textile material is selected from the group comprising wool, polysaccharide-containing textiles, protein-containing textiles, textiles formed of or containing synthetic resins, textiles containing inorganic fibers, and a combination of any two or more such fibers.

3. A textile material according to claim 1 wherein said composition, optionally containing a pigment or dye, is coated onto or impregnated in said textile material.

4. A process for improving the properties of a textile material in which a composition comprising an admixture of:

(a) an aqueous emulsion of a copolymer of a monomeric mixture consisting essentially of an oxirane-containing monoethylenically-unsaturated material and at least one other monoethylenically-unsaturated material selected from the group characterized by the formula

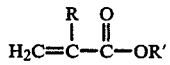

wherein R is H or $C_1$ to $C_4$ alkyl and R′ is a straight chain or branched chain radical of a primary or secondary alkanol, akloxyalkanol or alkylthiaalkanol having up to 14 carbon atoms, and (b) a water soluble or water dispersable polyamine which is composed of at least 4 alkylenimine units (—CH—CH—N—) which occur in sequences of such alkylenimine units having the formula A

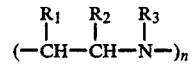

(A)

wherein $R_1$ and $R_2$ are independently selected from hydrogen, and lower alkyl radicals of 1 to 4 carbon atoms, $R_3$ is H or other alkylenimine sequences of formula A, and n is a number which as an average value of at least 2 wherein the admixture (a) and (b) is further characterized in that it exists as a stable emulsion at a pH in the range 3 to 11 and wherein the proportion of polyamine (b) is such that the sequences of alkylenimine units of formula A represent from 0.5% to 25% by weight of the non-volatile material in the combined mass of the emulsion copolymer and polyamine, is applied to the material which is then heated in order to dry and cure the composition.

5. A process as claimed in claim 4, wherein the composition is padded onto the textile material.

6. A process as claimed in claim 4, wherein the composition is exhausted from a long liquor by agitation of the textile materials in a bath consisting of or comprising the composition.

7. The process as claimed in claim 6, wherein the emulsion particles of the copolymerized monomers in the composition bear either a neutral or negative charge prior to their admixture with the polyamine in the bath.

8. A process as claimed in claim 6, wherein the polyamine in the composition is a polyethylenimine of molecular weight in the range 200 to 200,000 and is contained in an amount between 4 and 25% based on the weight of the non-volatile material in the combined mass of the emulsion copolymer and polyamine.

9. A process as claimed in claim 6, wherein the composition contains up to 2 g/l of a nonionic species which is soluble in cold water but becomes substantially insoluble at a temperature below 90° C.

10. A process as claimed in claim 6, wherein the composition contains up to 2 g/l of a nonionic surface active agent selected from alkylphenoxy-polyethoxy ethanols containing from 7 to 10 carbon atoms in the alkyl group and from 5 to 15 oxyethylene groups.

11. A process as claimed in claim 6, wherein the composition contains up to 2 g/l of nonionic water-soluble polymer having an inverse solubility-temperature relationship.

12. A process as claimed in claim 6, wherein the pH of the composition is adjusted such that the particles have a small positive zeta potential.

13. A process as claimed in claim 6, wherein the weight ratio of the liquid to textile material is in the range 5:1 to 100:1.

14. A process as claimed by claim 6, wherein the temperature of the bath is gradually raised to between 15° and 75° until the bath becomes substantially clear.

15. A process as claimed in claim 6 wherein the pH of the bath is in the range 4.5 to 10.0.

16. A process a claimed in claim 4, wherein the textile material is selected from the group comprising wool, polysaccharide-containing textiles, protein-containing textiles, textiles formed of or containing synthetic resins, textiles containing inorganic fibers, and a combination of any two or more such fibers.

17. A textile material when treated by process of claim 4.

* * * * *